United States Patent [19]

Koivuranta

[11] Patent Number: 5,074,966

[45] Date of Patent: Dec. 24, 1991

[54] GAP FORMER IN A PAPER MACHINE

[75] Inventor: Mauri Koivuranta, Petäjävesi, Finland

[73] Assignee: Valmet Paper Machinery Inc., Finland

[21] Appl. No.: 602,500

[22] Filed: Oct. 24, 1990

[30] Foreign Application Priority Data

Nov. 6, 1989 [FI] Finland ..... 895264

[51] Int. Cl.[5] ..... D21F 1/48

[52] U.S. Cl. ..... 162/301; 162/308; 162/363; 162/364; 162/369; 162/370

[58] Field of Search ..... 162/300, 301, 308, 335, 162/363, 376, 364, 368, 203, 369, 217

[56] References Cited

U.S. PATENT DOCUMENTS 3,839,143 10/1974 Suckow ..... 162/301

4,925,531 5/1990 Koski ..... 162/301

*Primary Examiner*—Peter Chin

*Attorney, Agent, or Firm*—Steinberg & Raskin

[57] ABSTRACT

A gap former in a paper machine, comprising a lower wire loop (10) and an upper wire loop (20), which together define a substantially horizontal twin wire forming zone, which comprises the following web forming zones (a), (b) and (c): (a) In the area of the forming gap (G), a first suction zone (11*a*) placed inside the first forming roll (11), and immediately thereafter a second suction zone (11*b*) is placed in forming roll (11). The suction zones (11*a*, 11*b*) are placed in the first upper quarter of the first forming roll (11) at the side of the forming gap (G). The levels of negative pressure ($P_1$, $P_2$) in the suction zones are adjustable. (b) A forming shoe (12), which is provided with an open guide deck (26), the interior space in the shoe being divided into at least two subsequent suction chambers (12*a*, 12*b*, 12*c*), the levels of negative pressure ($P_a$, $P_b$, $P_c$) effective in said suction chambers being arranged to be adjustable, preferably separately adjustable. (c) Web-formation and/or guide members (13*a*, 13*b*, 17, 25) arranged after the forming shoe (12), the members guiding the twin wire zone downwards.

16 Claims, 3 Drawing Sheets

10
11
11'
11a
11b
12
13a
13b
14
15
16
18
18a
19
20
21
22
23
24
26
30
31
W
P
G
K
(10, W, 20)
C

GAP FORMER IN A PAPER MACHINE

BACKGROUND OF THE INVENTION

The invention concerns a gap former in a paper machine, comprising a lower wire loop and a upper wire loop, which together define a substantially horizontal twin wire forming zone, which starts from the forming gap, which is confined in a space between the upper and the lower wire, this space becoming narrower so as to be wedge shaped, and in the area of which forming gap there is, inside the lower wire loop, a first forming roll, after the roll a forming shoe, after which, inside the lower wire loop, there are a number of dewatering members, after which the web is arranged to follow along with the lower wire, from which it is detached at the pick up point, being transferred onto a pick up fabric or equivalent.

With respect to the prior art most closely related to the present invention, reference is made to the U.S. Pat. Nos. 3,438,854, 3,996,098, and 4,056,433 as well as to the Published Finnish Patent Applications Nos. 61,217 and 77,702. Moreover, the prior art related to the present invention includes the former apparatus marketed by the Applicant under the trademark "SPEED FORMER HHS" ® (Appendix 1) and the former apparatus marketed by Messrs. Escher Wyss AG under the trademark "TWIN FORMER G" ®, the latter one being described, e.g., in the journal *Wochenblatt fur Papierfabrikation* 11/12, 1989, p. 482, section 3.5.1 (Appendix 2).

SUMMARY OF THE INVENTION

The present invention expressly concerns a gap former in which the twin wire forming zone is substantially horizontal, which is, in this connection, understood as meaning that the length of the twin wire forming zone in the horizontal direction is substantially larger, preferably at least twice as large as the difference in height between the forming gap and the final end of the twin wire zone. In formers meant for new paper machines, the forming gap and the final end of the twin wire zone may advantageously be substantially at the same level, whereas in formers in accordance with the invention intended for modernizations the forming gap may be placed at a level considerably higher than the final end of the twin wire zone, which preferably coincides with the upper plane of the fourdrinier wire to be modernized.

A general object of the present invention is further development of the gap formers described in the papers cited above, in particular of the Applicant's said "SPEED FORMER HHS" ® construction. A general object of the invention is to provide a former whose operation can be made such, by means of dimensioning and regulation of various operational parameters, that even with high production rates and with different qualities produced, the operation of the former can be optimized so that the formation and retention of the paper produced as well as the symmetry of its opposite faces and of the whole structure can be made excellent.

It is a particular object of the invention to provide a former in which the former roll placed in its gap area is opened upwardly, so that there is no risk of the suction chamber placed inside the former roll being filled with water, whereby it is possible to use a suction chamber of full width.

An object of the invention is to provide a former whose dewatering capacity can be increased further while, nevertheless, retaining good formation, retention and symmetry of the web.

It is a further object of the invention to provide a former which can be applied both to new machines and to modernizations of existing fourdrinier wire parts, such as the former marketed by the Applicant under the trademark "SYM-FORMER R" ®, in respect of which reference is made to the Applicant's FI Patent No. 75,375 (corresponding U.S. Pat. Nos. 4,614,566 and 4,744,866).

With a view to achieving the objectives stated above and those that will be explained hereinafter, the invention is mainly characterized in that the twin wire forming zone comprises a combination of the following web forming zones (a), (b) and (c) placed one after the other in the sequence stated below:

(a) in the area of the forming gap or immediately after it, a first suction zone placed inside the forming roll, and immediately thereafter a second suction zone placed inside the same forming roll, said suction zone being placed in the first upper quarter of the first forming roll at the side of the forming gap, and the levels of negative pressure in said suction zone being adjustable, preferably separately;

(b) a forming shoe, which curves the twin wire forming zone downwards at least at its rear end and which is provided with an open guide deck, the interior space in said shoe being divided into at least two subsequent suction chambers, and means for adjusting, preferably separately adjusting, the levels of negative pressure effective in said suction chambers;

(c) web formation and/or guide members arranged after said forming shoe, said members guiding the twin wire zone downwards.

The former in accordance with the invention is adjustable in a very versatile way, so that the dewatering and formation process is all times efficiently under control.

According to the invention, as the first former roll is placed inside the lower wire loop and as its suction zones are placed in the first upper quarter of the forming roll at the side of the gap, the negative pressure prevailing in the suction zones densifies the lower sides of the web that is being formed, in contrast with the above "SPEED FORMER HHS" ® former. This lower side of the web is typically less dense than its upper side. Thus, owing to the invention, a reduced unequalsidedness of the web is achieved.

The former in accordance with the invention is suitable both for new formers and particularly also for modernizations of fourdrinier wire parts, whereby it is possible to improve the quality and the rate of production of paper produced by means of fourdrinier wires substantially at relatively low investment costs.

BRIEF DESCRIPTION OF THE DRAWINGS

In the following, the invention will be described in detail with reference to some exemplifying embodiments of the invention illustrated in the Figures in the accompanying drawing, the invention being by no means strictly confined to the details of these embodiments.

DESCRIPTION OF THE PREFERRED EMBODIMENTS

Figure 1:
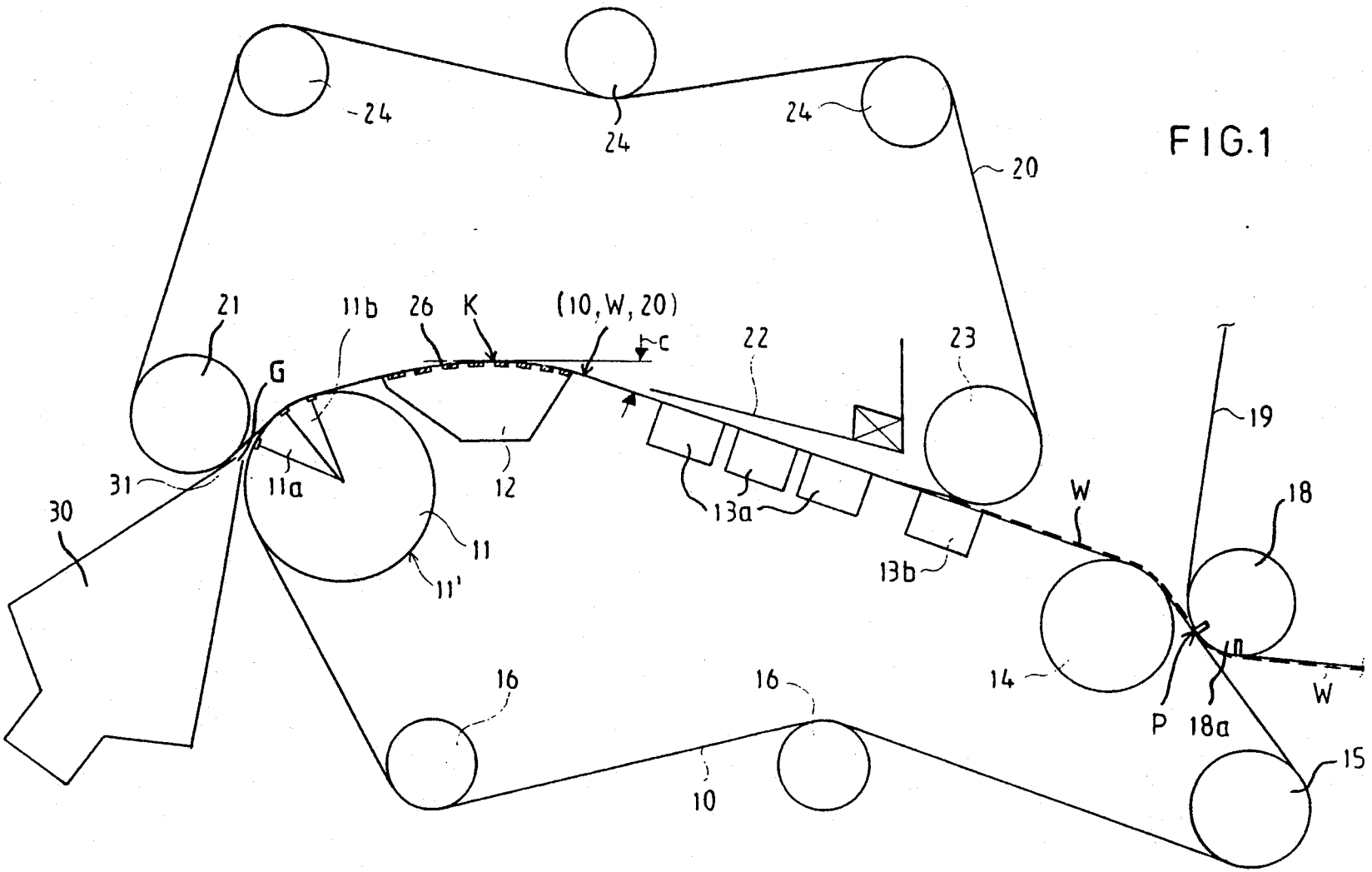
FIG. 1 is a schematical side view of a version of the invention that is intended for use in new paper machines.
Figure 2:
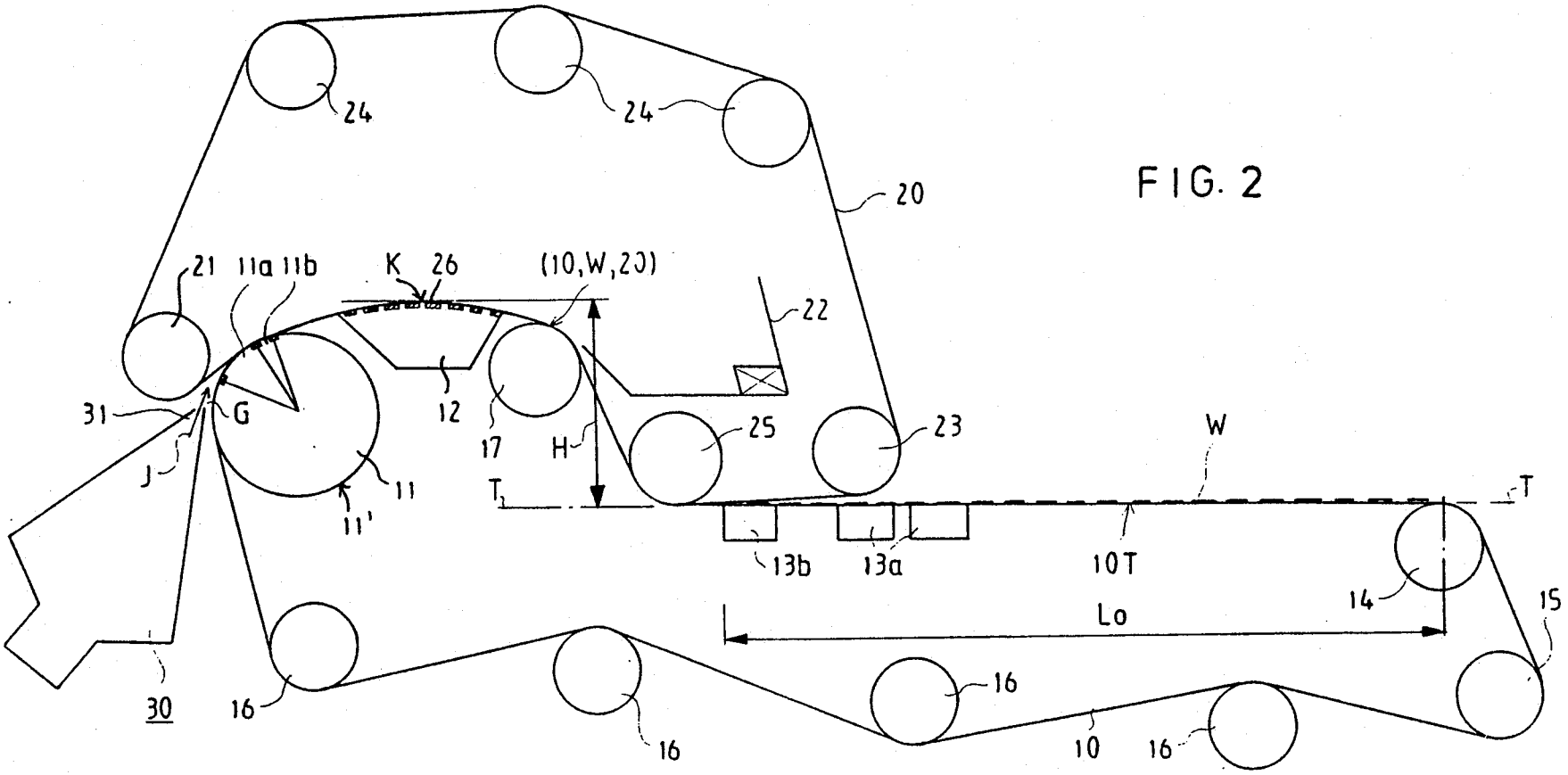
FIG. 2 shows a schematical side view of an embodiment of the invention for use in modernizations of fourdrinier wire parts.

The twin wire former of a paper machine shown in FIGS. 1 and 2 comprises a lower wire loop 10 and an upper wire loop 20, which together form a twin wire web forming zone. The twin wire zone starts at the forming gap G and ends at the suction box 13*b* placed inside the lower wire loop 10, after which the web W is arranged to follow along with the lower wire 10.

Inside the lower wire loop 10, there is a forming roll 11 in the area of the gap G, and it is followed by a forming shoe 12, suction boxes 13*a* and 13*b*, a couch roll 14, and a drive roll 15. On the downwardly inclined run of the lower wire 10 between the rolls 14, 15 the web W is transferred on the suction zone 18*a* of the pick up roll 18 onto the pick up felt 19, which carries the web W to the press section (not shows) of the paper machine. The return run of the lower wire 10 is guided by guide rolls 16.

Inside the upper wire loop 20, there is a guide roll 21 provided with a smooth solid face 21' (FIG. 3) in the area of the gap G, and it is followed by the twin wire forming zone between the wires 10 and 20. The upper wire 20 is separated from the lower wire 10 and from the web W by means of a suction box 13*a*. The guide roll 23 turns the run of the upper wire 20. The return run of the upper wire 20 is guided by guide rolls 24. Inside the upper wire loop, there is a water collecting trough 22, which collects the waters drained out of the web through the upper wire 20 especially in the areas of the roll 11 and the forming shoe 12.

Through the slice 31 in the headbox 30, the pulp suspension jet J is fed into the wedge-shaped forming gap G between the wires 10 and 20, the bottom of the gap being placed in the area of the first suction zone 10*a* of the forming roll 11. The forming roll 11 is provided with a perforated mantle 11', in whose interior there are two suction zones 11*a* and 11*b* placed one after the other. The suction zones are placed in the upper quarter of the roll 11 at the side of the gap G. It is an essential feature of the invention that the suction zones 11*a* and 11*b* in the former roll 11 are opened downwardly, so that the water is removed in the sectors a and b of the suction zones 11*a*, 11*b* with the aid of the wire tension, negative pressure, and gravity downwardly, so that there is no risk of the suction chambers placed in the suction zones 11*a* and 11*b* being filled.

Figure 3:
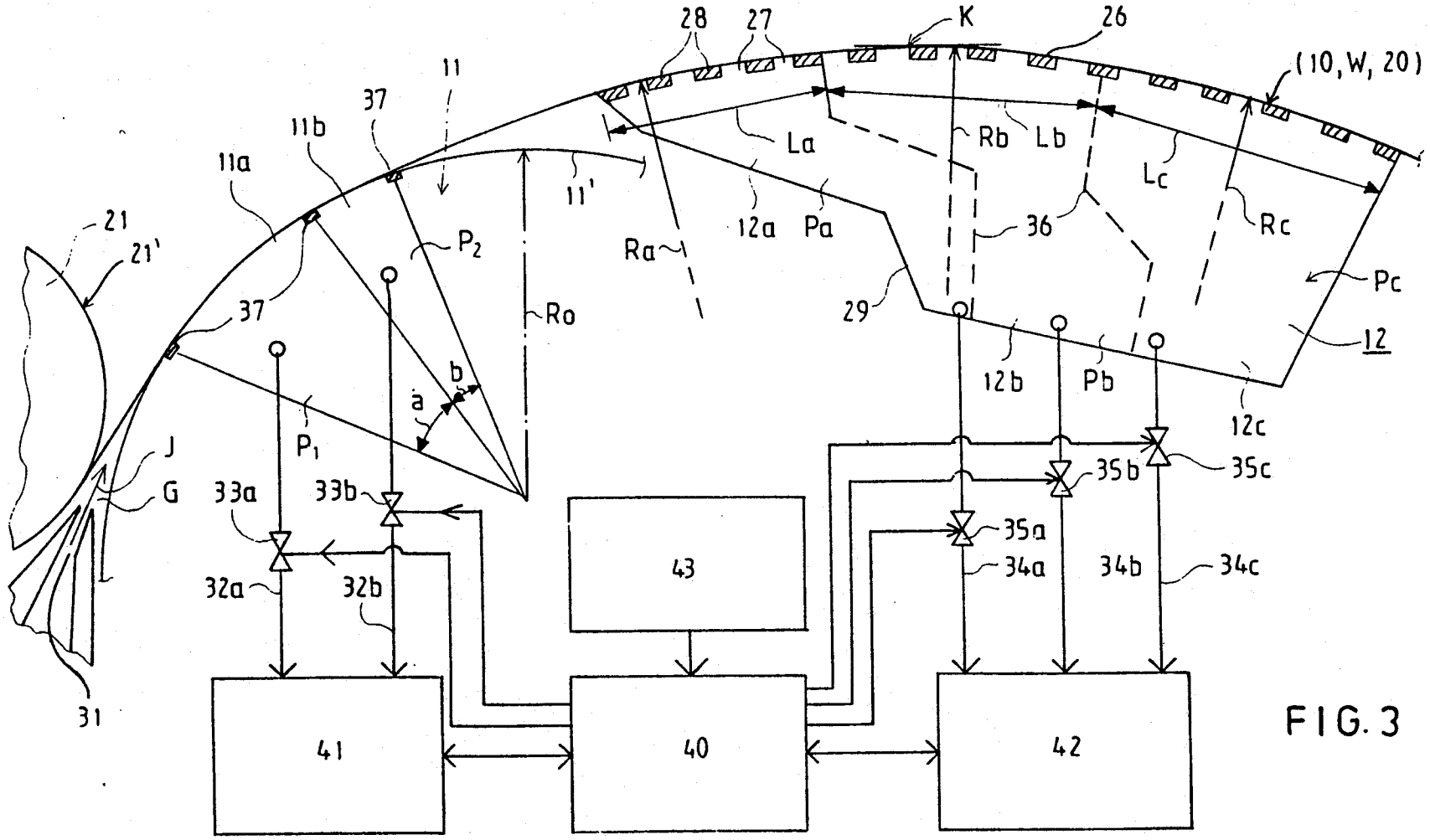
FIG. 3 shows the initial part of a twin wire forming zone in accordance with the invention on an enlarged scale.

As is shown in FIG. 3, the twin wire forming zone starts at, or at the proximity of, the foremost sealing rib 37 of the first suction zone 11*a*, the bottom of the forming gap G being, at the same time, placed at said rib. The joint run of the wires 10 and 20 is separated from the mantle 11*a* of the forming roll at, or at the proximity of, the rearmost sealing rib 37 of the second suction zone 11*b*, whereupon a short straight run of the wires 10, 20 follows. The diameter $2R_o$ of the roll 11 is, as a rule, within the range of $2R_o=1400$ to 1800 mm. The area of effect of the forming shoe 12 provided with a curved ribbed deck 26 starts thereafter.

As shown in FIG. 3, the sector of the foremost forming zone (11*a*) in the first forming roll (11) is substantially larger than the sector (b) of the directly following suction zone (11*b*), these sectors (a, b) preferably being within the respective ranges of 20 to 60 degrees and 10 to 20 degrees.

As is shown in FIG. 3, the forming shoe is divided into three subsequent suction chambers 12*a*, 12*b* and 12*c*, which are defined by partition walls 36, by the outer mantle 29, and by planar ends. The curved ribbed deck 26 of the forming shoe consists of ribs 28, whose longitudinal direction is perpendicular to the direction of running of the wires, and of gaps 27 between these ribs, which gaps 27 are opened into the vacuum chambers 12*a*, 12*b* and 12*c* in the shoe. The curve radius of the rib deck 26 placed facing the first chamber 12*b* is Ra, and its length is Ra, the curve radius of the deck of the second chamber is $R_b$ and its length is $L_b$ and the curve radius of the rib deck of the third chamber 12*c* is $R_c$ and its length is $L_c$. Most appropriately $R_a \geqq R_b \geqq R_c > R_o$ and, in a corresponding way, $L_a \geqq L_b \geqq L_c$. Advantageously, $R_o$ is within the range of $R_o=0.7$ to 0.9 m, $R_a$ is within the range of $R_a=3.0$ to 5.0 m, $R_b$ is within the range of $R_b=3.0$ to 4.5 m and $R_c$ is within the range of $R_c=2.5$ to 3.5 m. In a corresponding way, $L_a$ is within the range of $L_a=0.4$ to 0.8 m, $L_b$ is within the range of $L_b=0.35$ to 0.75 m, and $L_c$ is within the range of $L_c=0.30$ to 0.70 m.

The curve radii $R_a$,$R_b$, $R_c$ of the guide deck 26 of the forming shoe 12 have an effect on the web formation in that the curve radius R of the deck 26 determines the change (a) in angle taking place in the area of the shoe 12 in the direction of running of the wires 10, 20 at the tip of the rib of each deck 26. This change in angle produces in the web W a force vector $Fc=2 \cdot T \cdot \sin a$, wherein T = tensioning stress of the upper wire 20. As is well known, centrifugal forces and the negative pressure in the suction chambers of the shoe also act upon the dewatering pressure p.

It is an essential feature of the combination of the invention that the twin wire forming zone rises upwardly starting from the gap G, and the summit point K of the twin wire forming zone is placed at the ribbed deck 26 of the forming shoe, preferably in its middle area and at the middle chamber 12*b*.

In the former shown in FIG. 1, which is intended for new paper machines, the twin wire forming part is curved downwards after its summit point K placed at the forming shoe 2, and on this downwards inclined (angle c) and substantially straight run there are first three subsequent suction flatboxes 13*a* and thereupon a suction flatbox 13*b* at the leading roll 23 of the upper wire 20. This angle c is, as a rule, within the range of $c=10°$ to 40°.

The former shown in FIG. 2, which is intended for modernizations of existing fourdrinier parts, differs from that shown in FIG. 1 in the respect that after the forming shoe 12, inside the lower wire loop 10, there is a leading roll 17, in whose area the twin wire zone is curved steeply downwards onto the leading roll 25 placed inside the upper wire loop 20, which roll guides the twin wire zone to the horizontal plane T—T, which is at the same time the original operation plane of the fourdrinier wire to be modernized. The suction flatbox 13*b* ensures that the web W follows along with the planar part 10T of the lower wire, whose length is denoted with $L_o$. The existing frame parts, dewatering equipment and rolls 14, 5, 16 placed after the suction box 13 at the fourdrinier wire can, as a rule, be retained as such. The headbox 30 can be placed at least partly in the place of the old headbox and usually on the support of its stand constructions. The summit point K of the initial part of the twin wire zone is placed by the dimension H higher than the plane T—T. This difference in height H is, as a rule, within the range of H=1 to 3 m, preferably within the range of H=1.5 to 2.5 m, and the length of the planar part 10T of the wire 10 is, as a rule, within the range of $L_o$=4 to 8 m. The summit points of the forming roll 11' and of the leading roll 17 are preferably substantially on the same horizontal plane.

An essential feature of the operation of the former in accordance with the invention is its versatile adjustability, the adjustability being illustrated in FIG. 3. The perforated mantle 11' of the forming roll 11 is quite open, and its openness, i.e. the percentage R of holes, is preferably R=70 to 95%. The adjustability is contributed to by the fact that immediately after the gap G at least two, sometimes even three, subsequent suction zones 11*a*, 11*b* are used, whose levels of negative pressure are separately adjustable, which is illustrated in FIG. 3 by separate connecting ducts 32*a*, 32*b* of negative pressure, which communicate with the suction pump 41 via pressure regulation valves 33*a* and 33*b*. In this way it is possible to regulate the negative pressures $p_a$ and $p_b$ effective in the chambers 11*a* and 11*b* independently from each other. These levels of negative pressure are preferably within the range of $p_a$=0 to 10 kPa and $p_b$=0 to 30 kPa. The magnitudes of the sectors a and b of the suction zones 11*a*, 11*b* are preferably chosen so that a>b and that a and b are, as a rule, within the range of a=20° to 60° and b=10° to 20°.

The versatile adjustability of the former is also contributed to by the fact that, behind the ribbed deck 26 of the forming shoe 12, vacuum chambers 12*a*, 12*b* and 12*c* are effective, whose negative pressures $p_a$, $p_b$ and $p_c$ of different levels are also adjustable. This adjustment is illustrated in FIG. 3 by the suction ducts 34*a*, 34*b*, 34*c*, which are connected to the pump 42 of negative pressure through regulation valves 35*a*, 35*b* and 35*c* such that the negative pressures $p_a$, $p_b$ and $p_c$ can be regulated independently from each other. This regulation is illustrated by the regulation unit 40, to which, e.g., measurement results from the process computer of the paper machine concerning the operation of the former are fed. By, at the beginning, dimensioning the magnitudes of the sectors a and b of the suction zones 11*a* and 11*b*, the magnitudes of the curve radii $R_a$, $R_b$ and $R_c$ and of the lengths $L_a$, $L_b$ and $L_c$ of the forming shoe 12 in a purposeful way and by, during operation of the former, regulating the pressure levels $p_1$ and $p_2$ as well as $p_a$, $p_b$ and $p_c$ by means of the control system 40, 43, the operation of the former with the web speeds that occur and with the paper qualities and pulp qualities produced can be optimized so that the final result is an optimal formation, retention, and symmetry of the opposite faces and of the whole structure of the web.

Obviously, numerously modifications and variations of the present invention are possible in light of the above teachings. It is therefore to be understood that within the scope of the claims appended hereto, the invention may be practiced otherwise than as specifically disclosed herein.

What is claimed is:

1. A gap former in a paper making machine comprising:

a lower wire loop and an upper wire loop which together define a twin wire forming zone for a web, said upper wire loop and lower wire loop defining a forming gap where said web enters said twin wire forming zone, said twin wire forming zone running in a generally horizontal direction;

a first forming roll situated within said lower wire loop in said twin wire forming zone defining at least a portion of said forming gap, said first forming roll having means therein successively in the direction of movement of said web defining a first suction zone and a second adjacent suction zone, both of said first and second suction zones being situated in the corner of said forming roll adjacent to said forming gap;

means for separately adjusting the levels of negative pressure in said first and second suction zones; and a forming shoe situated within said lower wire loop in said twin wire forming zone, said forming shoe being situated subsequent to said forming zone, said forming shoe being situated subsequent to said forming roll in the direction of movement of said web and being configured such that said path of said web is curved downward as it leaves said forming shoe, said forming shoe having an open guide deck abutting said web, said forming shoe including an interior space divided into at least two suction chambers connected to a source of negative pressure, said suction chambers connected to said open guide deck; and means for adjusting the levels of negative pressure in said at least two suction chambers.

2. The gap former of claim 1, wherein said forming gap narrows in the direction of movement of said web.

3. The gap former of claim 1, further comprising a guide roll having a smooth solid face situated within said upper wire loop and defining at least a portion of said forming gap.

4. The gap former of claim 2, further comprising a guide roll having a smooth solid face situated within said upper wire loop and defining at least a portion of said forming gap.

5. The gap former of claim 1, further comprising means for guiding said web downwards after it leaves said forming shoe.

6. The gap former of claim 5, wherein said guide means comprises one or more suction boxes situated within said lower wire loop in said twin wire forming zone.

7. The gap former of claim 5, wherein said guide means comprises a leading roll situated within said lower wire loop subsequent to said forming shoe in the path of said web and functioning to curve said web steeply downward, and a second leading roll situated within said upper wire loop and functioning to guide said web to a substantially horizontal plane.

8. The gap former of claim 1, wherein the highest point of said twin wire forming zone is situated on said open guide deck of said forming shoe.

9. The gap former of claim 1, wherein said forming roll comprises a perforated mantle abutting said web and defining a sealing rib bounding said second suction zone, said sealing rib extending from the center of said forming roll upwards to said perforated mantle at a slight angle to the vertical within said quarter of said forming roll adjacent to said forming gap.

10. The gap former of claim 1, wherein said means for adjusting the levels of negative pressure in said at least two suction chambers comprises means separately connected to each of said at least two suction zones for separately adjusting the negative pressure in each suction zone.

11. The gap former of claim 1, wherein said first suction zone of said forming roll subtends an angle of the periphery of said forming roll which is substantially larger than the angle subtended by said second suction zone of said forming roll.

12. The gap former of claim 11, wherein said first suction zone subtends an angle of 20 to 60 degrees and said second suction zone subtends an angle of 10 to 20 degrees.

13. The gap former of claim 1, wherein said forming shoe comprises first, second and third suction chambers in sequential order relative to the direction of movement of said web, said first, second and third suction chambers having respective lengths on said ribbed deck of 0.4 to 0.8 m, 0.35 to 0.75 m, and 0.30 to 0.70 m, and the respective curve radii of said ribbed deck bounding said first, second, and third suction chambers are 3.0 to 5.0 m, 3.0 to 4.5 m, and 2.5 to 3.5 m.

14. The gap former of claim 5, wherein said guide means comprises two suction boxes situated within said lower wire loop and one of said two suction boxes terminates said twin wire forming zone by detaching said upper wire loop from said web.

15. The gap former of claim 7, wherein the highest point of said leading roll is substantially at the same point as the highest point of said first forming roll, and wherein the difference in height between the highest point of said twin wire zone and said substantially horizontal plane is 1.0 to 3.0 m.

16. The gap former of claim 15, wherein the difference between the highest point of said twin wire zone and said substantially horizontal plane is 1.5 to 2.5 m.

* * * * *